United States Patent [19]

Ohno et al.

[11] 4,023,898

[45] May 17, 1977

[54] ELECTROSTATIC DEVELOPING APPARATUS

[75] Inventors: Genji Ohno, Yokohama; Eiichi Inoue, Tokyo, both of Japan

[73] Assignee: Research and Development Laboratories of Ohno Co., Ltd., Japan

[22] Filed: May 30, 1975

[21] Appl. No.: 582,361

Related U.S. Application Data

[63] Continuation of Ser. No. 233,546, March 10, 1972, abandoned.

[52] U.S. Cl. ..... 355/10; 96/1 LY; 118/DIG. 23; 427/15

[51] Int. Cl.[2] ..... G03G 15/10

[58] Field of Search ..... 355/3 R, 10, 16, 17; 96/1 LY; 118/637 L, DIG. 23; 427/15, 16, 17

[56] References Cited

UNITED STATES PATENTS

| | | | |
|---|---|---|---|
| 3,096,198 | 7/1963 | Schaffert | 355/10 X |
| 3,472,676 | 10/1969 | Cassiers et al. | 355/10 |
| 3,486,922 | 12/1969 | Cassiers et al. | 427/15 |
| 3,669,073 | 6/1972 | Savit et al. | 118/637 |
| 3,817,748 | 6/1974 | Whittaker | 96/1 LY |

*Primary Examiner*—L. T. Hix
*Assistant Examiner*—J. A. LaBarre
*Attorney, Agent, or Firm*—Staas & Halsey

[57] ABSTRACT

This apparatus is disclosed for developing electrostatic latent images, comprising a developer supply unit having a first liquid repellent layer with a thickness in the range of 3 – 400$\mu$(preferably 5 – 330$\mu$). The first layer is disposed on a surface of a substrate, having a plurality of closely spaced pores distributed uniformly over the entire surface of the substrate and penetrating to the back surface thereof. A liquid developer is supplied to a first or back surface of this unit. A photoconductive sensitive plate is spaced closely to a front or second surface of the developer supply unit, to attract the developer to exude through the pores from the first surface of the said liquid repellent layer. More specifically, an electrostatic voltage is applied between the developer supply unit and the photoconductive sensitive plate to provide an electrostatic latent image preformed of electrostatic charges. Alternatively, a latent image could be formed by exposing the plate to light images or by the effect of pre-exposed light images on the said photoconductive sensitive plate.

18 Claims, 9 Drawing Figures

ELECTROSTATIC DEVELOPING APPARATUS

BACKGROUND OF THE INVENTION

1. Field of the Invention

This invention relates to a new method and apparatus for developing electrostatic latent images and, in particular, to those methods and apparatus using liquid developers.

2. Description of the Prior Art

The conventional electrostatic developing methods have been performed by both dry developing methods and liquid developing methods. Typically, electrostatic latent images are formed on a sensitive plate, which may alternatively take the form of a photoconductive layer of selenium disposed on a conductive substrate; a space charge type of sensitive plate comprised of an insulating film disposed on a surface of a photoconductive layer of cadmium sulfide; or a sensitive plate which is coated with a photoconductive fine powder such as zinc oxide, titanium oxide, etc., mixed with a resin binder and coated on a conductive substrate. The electrostatic latent images are developed by attracting in a dry process charged, fine colored particles to the electrostatic images by electrostatic forces in the case of dry developing, or by electrophoretically attracting to the latent image charge, in a liquid process, fine colored particles suspended in a liquid carrier of high resistance and low dielectric constant.

In these methods, however, there were defects, such as the scattering of the developer powder, the complexity of the developing apparatus, the low resolution of the reproduced images, in the case of the dry method; and defects, such as, the odor, poison, risk of fire due to the discharge breakdown, of the liquid developer in the case of liquid developing.

SUMMARY OF THE INVENTION

An object of this invention is to remove the defects of these conventional electrostatic developing methods, and to provide a new liquid type of electrostatic developing method and its corresponding apparatus, in which the liquid is odorless, not poisonous, and presents no risk of fire, and in which the non-image portions of the reproduced image are not contaminated.

This invention relates to a liquid electrostatic developing method, in which a developer supply unit is comprised of a liquid repellent layer, having a thickness of 3 – 400$\mu$(preferably 5 – 330$\mu$), disposed on a surface of a substrate. A plurality of uniformly distributed, minute pores are closely spaced over the entire surface of the substrate and penetrate from the front to the back surface. A liquid developer is supplied from the back surface of this unit. A photoconductive sensitive plate is arranged closely to front the surface of the said developer supply unit. The developer is caused to exude from the back surface of the liquid repellent layer by applying an electrostatic voltage between the said developer supply unit and the photoconductive sensitive plate to develop a latent image preformed thereon of electrostatic charges or formed by exposing the plate to light images or by the effect of pre-exposed light images on the photoconductive sensitive plate.

In contrast to conventional methods, the developer or the composing liquid of the developer adheres only to the latent image portions or, alternatively, the non-latent image portions formed on the surface of the photoconductive sensitive plate, i.e. conductive portions, of a photoconductive sensitive plate surface exposed with the light image. Therefore, the amount of drying required is reduced, thus increasing the speed of developing.

In accordance with a further feature of this invention, the development is performed on the basis of electrostatic induction or the electrostatic polarization of the developer and the reduction of the contact angle between the developer and the liquid layer. As a result, it no longer is necessary to use a carrier liquid of high resistance and low dielectric constant as used in the conventional liquid developing methods and, therefore, the use of a developer having an objectionable odor, being poisonous, or presenting the risk of fire due to the discharge breakdown, can be avoided because the composing liquid of the developer of this invention allows the use of a liquid such as water.

A further feature of this invention is that the developing apparatus is simple compared with that used for dry developing methods because this method uses a liquid developer. Another feature of this invention is that a positive or negative image may be obtained by selecting the polarity of electrostatic voltage to be applied to develop a single electrostatic latent image to furnish either positive or negative reproductions.

BRIEF DESCRIPTION OF THE DRAWINGS

This invention will be more fully described in conjunction with the drawings, which include.

DETAILED DESCRIPTION OF THE PREFERRED EMBODIMENTS

In general, the contact angle of a liquid-drop on a liquid repellent surface is more than 90° and the liquid-drop does not dampen the liquid repellent surface. However, the contact angle will decrease when the liquid repellent surface is charged with electricity. When the properties of the liquid repellent surface, the type of liquid developes, and the magnitude of the voltage charge, are selected properly, the contact angle becomes less than 90° to dampen the liquid repellent surface. For example, the contact angle of a water-drop on the surface of 4-fluoro ethylene film is 108°; when a 500V charge is applied to this film, the contact angle decreases to 56° and the water-drop dampens the liquid repellent surface.

Figure 1:
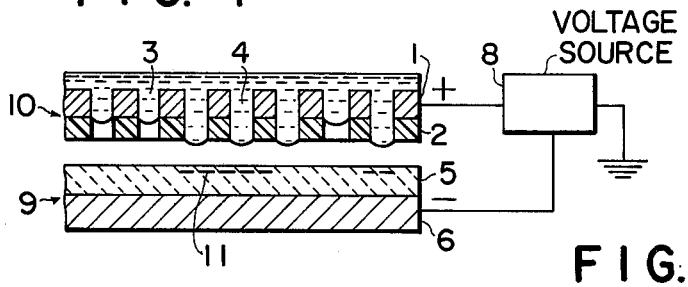
FIGS. 1 and 2 are explanatory diagrams of the invention which use a photoconductive sensitive plate having a surface for receiving an electrostatic latent image.

In FIG. 1, a liquid repellent layer 2 is shown, having a thickness in the range of 3 – 400$\mu$ and preferably in the range of 5 – 330$\mu$. The layer 2 is provided on the surface of a conductive substrate 1, having a plurality of fine pores 4, which are distributed uniformly and closely spaced from each other over the entire surface of the substrate. The pores 4 penetrate from the back to the front surface. Thus a liquid developer supply unit 10 is formed of the substrate 1 and the layer 2. A liquid developer 3 is supplied from the back surface of the unit 10. The contact angle of the developer 3 is chosen to be less than 90° with respect to the conductive substrate 1, and more than 90° with respect to the liquid repellent layer 2, by selecting the surface tension of the liquid developer 3. The developer 3 readily enters the minute pores 4 of the porous conductive substrate 1, exuding therethrough to the substrate's boundary with the liquid repelling layer. Further permeating is prevented due to the liquid repellency of the layer 2.

Figure 3:
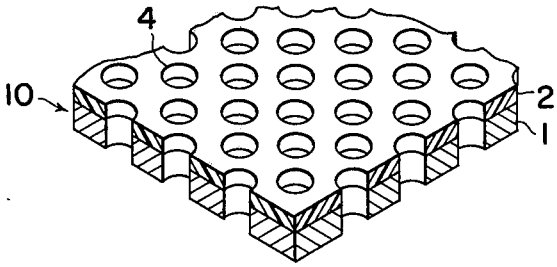
FIG. 3 is an orthogonal, enlarged view of the developer supply unit of this invention.

As indicated in FIG. 3, the developer supply unit 10 of this invention is made by disposing the liquid repellent layer 2 upon the surface of the substrate 1, with a plurality of minute pores 4 uniformly distributed and closely spaced over the entire surface of the substrate 1 and penetrating from the back to the front surface.

Now, electrostatic latent images 11 are formed by any of the well known methods on the surface of a sensitive plate 9 which comprises photoconductive layer 5, made of a suitable photoconductive material such as zinc oxide resin series, photoconductive selenium, or others, and a conductive substrate 6. The sensitive plate 9, having an electrostatic latent image 11 thereon, is arranged closely to front surface of the liquid repellent layer 2 of the developer supply unit 10. An electrostatic voltage is applied by a voltage source of the substrate 1 of the developer supply unit 10, of an opposite polarity with respect to the latent image charge and to the conductive substrate 6 of the sensitive plate 9, of the same polarity as the latent image charge. The voltage source 8 is interconnected between the porous, conductive substrate 1 of the developer supply unit 10 and the conductive substrate 6 of the sensitive plate 9. Thus, at the portions of the sensitive plate 9 where the latent image has been formed, the electric field emanating from the electrostatic charge of the image and that field established by the applied voltage are disposed in the same direction. Therefore, the strength of the field established by the electric field between the developer supply unit 10 and the sensitive plate 9 increases as the sum of both fields. At the portions of the sensitive plate 9 where no latent image exists, only the electric field due to applied voltage is established, and the intensity of this electric field is weaker than that field established in those portions where the latent image exists.

The liquid developer 3 of the supply unit 10 is exposed to the strong electric field in those portions of the plate 9 where the latent image portions generate an electrostatic polarization or electrostatic induction, and is attracted by the action of the strong electric field through the pores 4 towards the plate 9. At the same time, the contact angle of the developer with the inside surfaces of the minute pores 4 of the liquid repellent layer 2 decreases to a value less than 90°. Thus, the developer 3 dampens the inside of the minute pore 4, and the attractive force on the developer 3 becomes greater than the surface tension of the developer 3 within the minute pores 4. As a result, the developer 3 enters into the minute pores 4 of the liquid repellent layer 2 and exudes onto the surface of the layer 2.

Thus, the developer 3 exudes onto the surface of the liquid repellent layer 2 of the said developer supply unit 10, where the latent image exists, but does not exude onto the layer 2 where no latent image exists, for a given range of applied voltages. Then, the developer 3 exuded onto the surface of the liquid repellent layer 2 is brought in contact and is absorbed by the latent image portions of the sensitive plate surface 9, and develops these images in a positive state.

The developing voltage varies with the kind and the thickness of the liquid repellent layer 2, the kind and developing velocity of the developer 3, and the magnitude of the latent image charge. According to the results of experiments, the developing voltage was selected to be in the range of 0V to 2,000V (preferably 0V to 1,500V), and the thickness of the liquid repellent layer 2 selected to be in the range of 3 – 400$\mu$(preferably 5 – 330$\mu$). When the applied voltage exceeds 2,000V, creeping discharge occurs to decrease the image resolution. When the thickness of the liquid repellent layer 2 is less than 3$\mu$, the repelling force of the developer 3 at the non-image portions becomes weaker, and foreign matter tends to adhere to the minute pores 4 or to the roughness of the photoconductive sensitive plate 5 to cause the non-image portions to be contaminated. When the thickness of layer 2 exceeds 400$\mu$, the electric-field established in the minute pores 4 are weakened and the contact angle of the developer 3 is insufficient to cause the developer 3 to exude from the surface of the liquid repellent layer 2 by electrostatic induction or electrostatic polarization; as a result, the developing velocity decreases remarkably.

Figure 2:
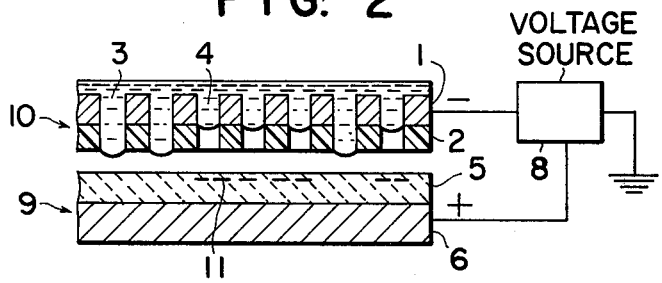

As shown in FIG. 2, when an electrostatic voltage of the same polarity as the latent image charge is applied to the developer supply unit 10 and a voltage of opposite polarity is applied to the conductive substrate 6 of the sensitive plate 9, the electric field established between the developer supply unit 10 and the sensitive plate 9 is relatively weak at those portions where the latent image exists and is relatively strong at those portions where no latent image exists. Therefore, the developer 3 exudes onto the liquid repellent surface 2 of the developer supply unit 10 adjacent to those portions of the sensitive plate 9 where no latent image exists; thus the exuded developer is absorbed into and adheres to those portions of the non-latent image surface. However, the developer does not exude onto those portions of the layer 2 fronted to those portions of the plate 9 where the latent image exists. Therefore, the sensitive plate 9 is developed in negative state. The applied voltage of this case is selected to be in the range of 30V to 2,000V (preferably 30V to 1,500V). When the applied voltage is less than 30V, the developing time is extended significantly.

Figure 4:
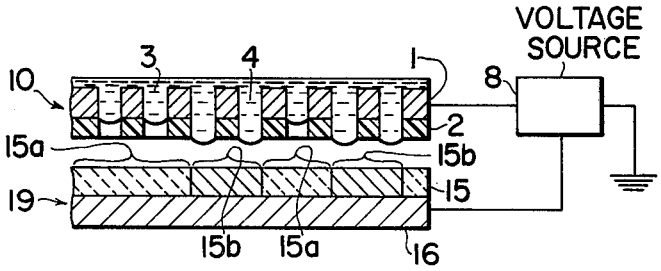
FIGS. 4 and 5 are cross-sectioned views of the invention which use a photoconductive sensitive plate during and after the light image exposure.

In FIG. 4, the composition and function of the developer supply unit 10 are similar to that shown and explained with respect to FIGS. 1 to 3.

When a light image corresponding to an original image is exposed to a photoconductive layer 15 of a sensitive plate 19 arranged closely to front surface of the supply unit 10, the electric resistance of the exposed portions of the layer 15 decreases and these portions become conductive. There are two kinds of conductivity depending upon the composition of the photoconductive layer 15. One type of conductivity vanishes as soon as the light exposure ceases, and the other type of conductivity continues after the light exposure has ceased. In this invention, the conductivity remains as long as an electrostatic voltage is applied between a conductive substrate 16 of the photoconductive plate 19 and the conductive substrate 1 of the developer supply unit 10, as indicated in FIG. 4. Thus, the developer 3 is prevented from exuding onto the liquid repellent layer 2, because the electric field established through the unexposed portions 15*a* of the photosensitive plate 19 is much weaker than the electric field established through the exposed portions 15*b*, where the thickness of the liquid repellent layer 2 is greater than a specified value. But, as the electric field of the exposed portions 15*b* becomes stronger than the electric-field of the unexposed portions due to the decrease of the resistance and the increase of the capacitance of the photoconductive layer 15, the liquid developer 3 is directed through the minute pores 4 under the influence of the electrostatic field, which generates an electropolarization and an electroinduction to reduce the contact angle of the developer with respect to the inside surfaces of the minute pores 4 of the layer 2. As a result, the developer 3 exudes onto the surface of the unit 10 and contacts the exposed portions 15*b* of the photoconductive plate 19 to develop the latent image.

The electrostatic pattern, due to the decrease of resistance and the increase of capacitance of the layer 15, is established when a voltage is applied. However, the latent image may be formed by exposure to the light image either after the photoconductive plate 19 has been disposed adjacent to the developer supply unit 10, or the plate 19 may be first exposed to the light image and then arranged close to front surface of the developer supply unit 10.

The size of the minute pores 4 of the developer supply unit 10 of this invention varies with the resolution of the images required; the pore size has been selected to be in the range of 10 – 100$\mu$(preferably 10 – 50$\mu$) to obtain business copies, and the distance between the pores 4 has been selected to be in the range of 10 – 100$\mu$. When the size of a minute pore 4 is less than 10$\mu$, the pore becomes blocked, especially when the developer supply unit is used repeatedly. When the pore size is larger than 100$\mu$, the liquid repelling force of the liquid repellent layer 2 is weakened and the non-latent image portions of the electrostatic latent image forming unit 19 tend to be contaminated and the reproduced images become visually rough. When the distance between the minute pores is less than 10$\mu$ or more than 100$\mu$, the image resolution, in each case, decreases remarkably. Such fine porous substrate 1 can be made readily by well known methods such as those used to make porous metallic filters, or by perforating the minute pores of the desired sizes by photoetching a copper (or other metal) plate. A metallic screen having spaces of the desired sizes can also be used as the substrate of this invention.

The liquid repellent layer 2, which gives the liquid repellency characteristic to the fine porous substrate 1, can be formed by first connecting the substrate 1 to a first polarity of a voltage source and electrodepositing and drying liquid particles sprayed onto the substrate, which were charged to an opposite polarity at the time of spraying. A solution such as polyethylene, polystyrene, alkyd resin or silicone varnish, etc. may be sprayed onto the substrate 1. When the composing liquid of the developer is water or contains water, the layer 2 can be formed of a thin film of an oil, such as mineral oil, on the surface of the substrate 1.

In addition to the materials mentioned above, all materials that have a contact angle with respect to the liquid developer 3 greater than 90° in the absence of an electric-field, and less than 90° in the presence of the electrostatic field, can be used as the materials of the liquid repellent layer 2 of this invention.

Developers used in this invention are liquid and include coloring agents, contact angle adjusting agents and viscosity adjusting agents. The liquid used in the developer of this invention must exhibit an affinity with substrate 1 of the supply unit 10, to achieve a contact angle not less than 90° with respect to uncharged surface of the layer 2 and less than 90° when exposed to the electrostatic field applied at the time of developing to thereby wet the surface of layer 2. If the liquid repellent material is made of polyethylene, polystyrene, poly 4-fluoroethylene, poly 3-fluoroethylene chloride, silicone varnish or alkyd resin; water, glycerine or ethylene glycol may be used as the developer solvent.

The coloring agent may be added to a solution, suspension or mixture of these aforementioned components. When water is used, hydrophilic dyes such as malachite green, methyl violet, victoria blue and persian orange are used. If a small amount of ethyl alcohol is contained as a contact angle adjusting agent, alcohol soluble dyes such as pigment green and carmine FB are used.

An organic or inorganic pigment such as carbon black and phthalocyanine may be dispersed into liquid by a suitable dispersing agent and is used as suspended coloring agent.

Contact angle adjusting agents are used for obtaining optimum contact angle in relation with the liquid repellent property of the photoconductive photosensitive plate and the desired developing speed. Suitable contact agents are prepared by mixing two liquids having different surface tensions or utilizing a small amount of surface activator.

Viscosity adjusting agents are used for adjusting the fluidity of ink in relation with the developing speed. Liquid-soluble resins, for example, polyvinyl alcohol, dextrin, gelatin as methylol, melamine, are used when the liquid is water. Viscosity adjusting agents also serve to fix the coloring agent to the paper when the developer has dried.

Figure 5:
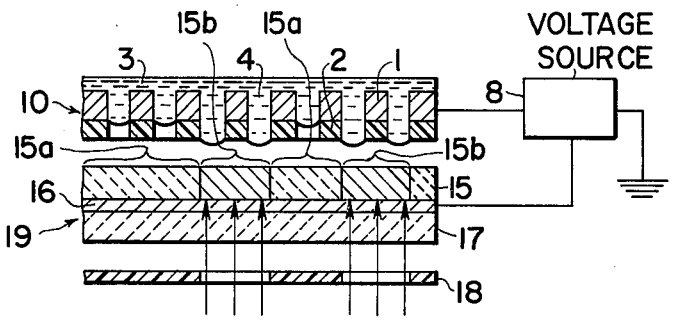

The sensitive plate 9 as described in FIGS. 4 and 5, may be formed of a layer of such fine photoconductive powders as zinc oxide, titanium dioxide or zinc sulfide mixed with a binder resin and vapor deposited onto a photoconductive selenium film, or may be made up of an organic, photosemiconductor such as polyvinyl carbazol (or others) disposed on a conductive substrate.

These photoconductive layers exhibit a fatigue phenomena (or after-effect phenomena) after being exposed to light to maintain its electroconductivity for a period after exposure to thereby trap materials on the photoconductive layer, thereby adversely effecting the development of further images. However, as shown in FIG. 5, the photoconductive layer 15 is disposed on a conductive substrate comprised of a transparent layer 17 and a transparent conductive layer 16, such as a Nesa layer. The development is performed by applying an electrostatic voltage between the sensitive plate 19 and the developer supply unit 10 and exposing the light images to the sensitive plate 19, which has almost no after-effect phenomena.

The applied voltage may vary with the desired speed of developing, the type of the liquid repellent layer 2 of the developer supply unit 10, and the surface tension and the viscosity of the developer 2; the voltage has been varied in the range of 30V to 2,000V with satisfactory results.

As the surface tension of the liquid developer 3, the contact angle of the developer with respect to the layer 2, and the thickness of the liquid repellent layer 2, increase, a greater applied voltage is required for satisfactory development.

As the viscosity of the developer 3 becomes greater, the optimum developing voltage becomes greater. As the desired developing velocity becomes faster, the applied voltage required becomes greater. The effect of the applied voltage on the developing velocity is not so remarkable as that of the applied voltage on the surface tension and viscosity of the liquid developer.

When the applied voltage is less than 30V, non-uniform development is caused, and when the voltage is more than 2,000V, creeping discharge is caused to decrease the image resolution.

Figure 6:
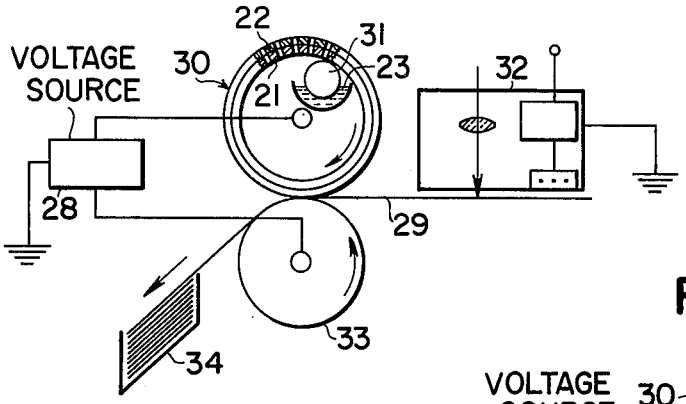
FIGS. 6 and 7 are side views of embodiments of the developing apparatus of the invention corresponding to FIGS. 1 and 2, and FIGS. 4 and 5, respectively.

FIG. 6 illustrates an embodiment for the developing apparatus of this invention which employs a photoconductive sensitive web similar to that shown in FIGS. 1 and 2. In particular, a roller 31 draws up and supplies the liquid developer 23 to the inside surface of the developer supply unit 30. The unit 30 comprises a liquid repellent layer 22 disposed on the surface of a cylindrical conductive substrate 21, having a plurality of uniformly distributed minute pores, closely spaced over the entire surface of the substrate 21. A roller 33 disposes a sensitive web 29 similar to the sensitive plates discussed above towards the outside surface of the unit 30. An electrostatic voltage is applied by a voltage source 28 between the unit 30 and the roller 33.

Electrostatic latent images are formed on the sensitive web 29 by a latent image-forming apparatus 32, before the web 29 is directed between the unit 30 and the adjacent roller 33. When the electrostatic voltage is applied between the unit 30 and the adjacent roller 33 by the power supply 28, the developer 23, which is supplied by the draw-up roller 31 to the inside of the unit 30, exudes onto the outside surface of the unit 30 according to the polarity of applied voltage, to be transferred to the surface of the sensitive web 29. The latent images may be developed in either the positive or negative state. After development, the sensitive web 29 is transferred into a receptacle 34.

Figure 7:
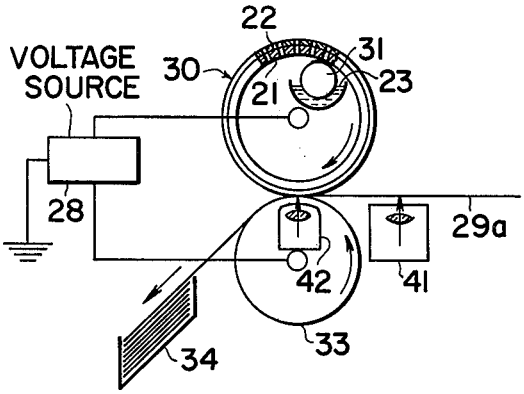

FIG. 7 illustrates an embodiment of the developing apparatus of this invention which employs a photoconductive sensitive web 29*a* similar to that shown in FIGS. 4 and 5. In place of the latent image-forming apparatus 32 shown in FIG. 6, there is provided a light image exposure unit 41 to expose the web 29*a* before being directed to roller 33 where development takes place. Alternatively, a light image exposure unit 42 may be provided within the roller 33 to develop and to expose the web 29 to a light image at the same time. The unit 42 is arranged to expose the light images on the parts of the photoconductive layer of the sensitive web 29*a* which contact the surface of the developer supply unit 30 without regard to the rotation of the roller 33.

Figure 8:
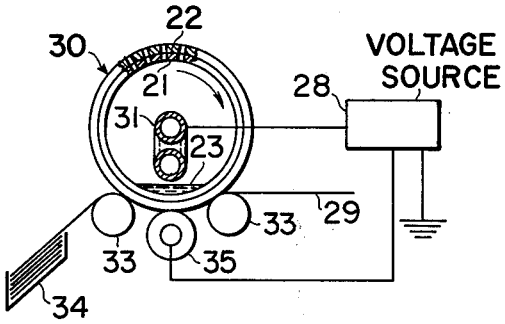
FIG. 8 shows a side view of another embodiment of the developing apparatus of this invention.
Figure 9:
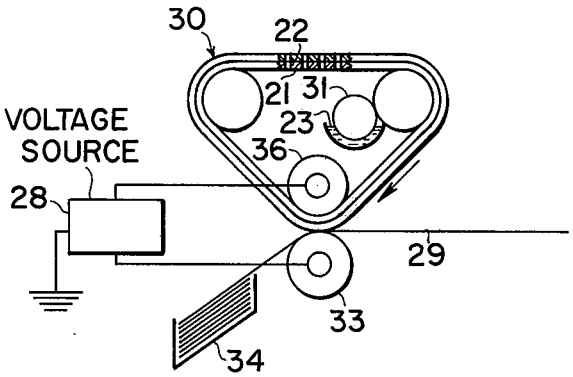
FIG. 9 shows a side view of another embodiment of the developing apparatus of this invention in which the developer supply unit of this invention uses an endless belt.

The roller 33, which presses the sensitive plate 29 onto the unit 30, also serves as an opposing electrode to apply an electrostatic voltage between the sensitive web 29*a* and the unit 30 in a manner similar to that shown in FIG. 6. A roller(s) such as roller electrode 35 as shown in FIG. 8 may be used to apply the electrostatic voltage. The developer may be supplied to the inside surface of the unit 30 by the use of an axis of the cylindrical unit 30 in a manner similar to that shown in FIG. 8. The developer supply unit 30 could also take the form of the endless belt as shown in FIG. 9.

EXAMPLE 1

The negative electrostatic latent image is formed by one of the well known methods, on a photoconductive sensitive plate which is coated and dried with a sensitive liquid up to a thickness of 25$\mu$ on the conductive substrate. The sensitive liquid is composed of:

| | |
|---|---|
| Zinc oxide | 100g |
| Bromphenol blue (1% solution) | 1.5cc |
| Rose bengal (1% solution) | 1.5c |
| Fluorescein (1% solution) | 1.5cc |
| Styrene butadiene copolymerized resin | 30g |
| Toluene | 60cc |

The liquid repellent layer is formed by spraying a silicone varnish (parts of resin, 5%), through a spray nozzle to which a voltage of 1KV has been applied, onto a stainless steel screen. The screen is disposed at one polarity, while the sprayed liquid particles are charged to the opposite polarity to be electrodeposited, dried, and then fixed by baking to provide a liquid repellent layer of 60$\mu$ thickness formed on one surface of the metallic screen (of 250 mesh). Thus, the metallic screen is provided with the liquid repellent layer to be used as a developer supply unit.

Next, an aqueous liquid developer comprised of the following components is applied to the back surface of the supply unit:

| | |
|---|---|
| Carbon black | 7g |
| Victoria blue | 0.15g |
| Gelatin | 2g |
| Glycerine | 15g |
| Water | 100cc |

The photoconductive sensitive plate upon which the electrostatic image is formed, is arranged closely to front the supply unit. When a voltage of 300V was applied between the conductive substrate of this sensitive plate and the supply unit so that the supply unit becomes positive and the sensitive plate becomes negative, a latent image was developed clearly in positive state and colored blue-black.

Also, when an electrostatic voltage of 800V was applied so that the sensitive plate was positive and the developer supply unit was negative to develop the latent image, a clear blue-black negative image was obtained. Clear images were also obtained when a voltage of 1,200V was used.

EXAMPLE 2

A liquid repellent layer of a low polymerized polyethylene with a mean thickness of 20$\mu$, was formed in the same way as the Example 1, on a conductive substrate. A plurality of uniformly distributed, minute pores of 40$\mu$ diameter, were formed through the substrate by photoetching to a density of 140 pores per mm$^2$ over the entire surface of a copper plate of 100$\mu$ thickness. This plate was used as the developer supply unit.

Next, a liquid developer comprised of the following components was supplied uniformly to the back surface of the supply unit:

| | |
|---|---|
| Victoria blue | 3g |
| Persian orange | 5g |
| Polyvinyl alcohol (3% solution) | 50cc |
| Glycerine | 7cc |
| Water | 50cc |

Next, a negative electrostatic latent image was formed by one of the conventional methods on an electrophotograph sensitive paper comprised of a dispersion of zinc oxide resin, to be closely spaced from the front of the liquid repellent surface of the supply unit. When an electrostatic voltage of 280V was applied so that the developer supply unit was positive and an electrode plate contacting with the back surface of the electrophotograph sensitive paper was negative, a clear positive image was obtained. Also, an electrostatic voltage of 500V was applied so that the developer supply unit was negative and the fronted electrode plate was positive, to develop a clear negative image.

EXAMPLE 3

A silicone varnish (parts of resin, 5%) was sprayed through a nozzle. A 1KV voltage source was interconnected between this nozzle and a metallic screen so that the sprayed liquid particles were of an opposite polarity to that of the screen. The particles were electrodeposited, dried, and then fixed by baking, to provide a liquid repellent layer of 60$\mu$ thickness formed on one surface of a brass screen of 250 mesh. This screen was used as a developer supply unit.

Next, a liquid developer comprised of the following elements is uniformly supplied to the back surface of the supply unit:

| | |
|---|---|
| Methylene blue | 6g |
| Polyvinyl alcohol (3% solution) | 50cc |
| Water | 50cc |

The surface of the liquid repellent layer of the supply unit was arranged closely to the front surface of the sensitive plate which was formed by coating and drying a sensitive liquid of a thickness not in excess of 30$\mu$ on a conductive substrate. The sensitive liquid was then exposed to light images for a period of two second by a tungsten lamp of 150 luxes. This sensitive liquid was composed of:

| | |
|---|---|
| Zinc oxide | 100g |
| Bromophenol blue (1% solution) | 2cc |
| Rose bengal (1% solution) | 2cc |
| Styrene butadiene copolymerized resin | 40g |
| Diphenyl picrylhydrazyl | 0.4g |
| Toluene | 60cc |

Next, an electrostatic voltage of 50V was applied between the substrate of the supply unit and the sensitive plate to cause the developer to be exuded onto the surface of the developer supply unit. The unit is disposed adjacent to the portions of the sensitive plate exposed with a light image according to the original negative image. The exuded developer was contacted with and absorbed by the sensitive plate, and the light image exposed portions were developed to produce a clear blue image. A voltage of 700V was applied to obtain the clearest images.

EXAMPLE 4

A liquid repellent layer of 50$\mu$ thickness was formed in the same way as the Example 3, on a conductive substrate, perforated with a plurality of uniformly distributed pores of a 40$\mu$ diameter. The pores were formed by photoetching to a density of 125 pores per $mm^2$ over the entire surface of a copper plate of 100$\mu$ thickness. The resultant plate was used as a developer supply unit.

Next, a liquid developer of the following components was applied to the back surface of the supply unit:

| | |
|---|---|
| Victoria blue | 3g |
| Persian orange | 5g |
| Polyvinyl alcohol (3% solution) | 50cc |
| Ethylene glycol | 3g |
| Water | 50cc |

The liquid repellent surface of the supply unit was arranged closely to front surface of the sensitive plate, which was coated with a sensitive liquid and dried to provide a layer of a thickness not greater than 40$\mu$. The sensitive liquid was vapor-deposited onto the conductive transparent tin-dioxide (Nesa) film. This sensitive liquid was composed of:

| | |
|---|---|
| Zinc oxide | 100g |
| Bromophenol blue (1% solution) | 1.5cc |
| Rose bengal (1% solution) | 1.5cc |
| Fluoresceine | 1.5cc |
| Styrene butadiene copolymerized resin | 30g |
| Toluene | 60cc |

A negative light image was directed through the transparent layer of the sensitive plate. An electrostatic voltage of 500V was applied between the developer supply unit and the transparent layer of the sensitive plate. The sensitive plate was clearly developed as a positive image of the original figure in the same manner as the Example 3. When voltage of 1,500V was applied, a clear image was obtained.

Numerous changes may be made in the above-described apparatus and the different embodiments of the invention may be made without departing from the spirit thereof; therefore, it is intended that all matter contained in the foregoing description and in the accompanying drawings, shall be interpreted as illustrative and not in a limiting sense.

What is claimed is:

1. Apparatus for developing electrostatic latent images with a liquid developer, said apparatus comprising:

means having first and second surfaces, for selectively transferring the liquid developer from said first surface to said second surface, said transfer means composed of an electrically conductive substrate having an affinity with the liquid developer and forming said first surface and a liquid repellent layer on said electrically conductive substrate forming said second surface wherein a boundary is formed between said substrate and said layer, said transfer means having uniformly closely spaced pores extending therethrough from said first surface to said second surface;

means for supplying the liquid developer to said first surface of said transfer means;

a photoconductive medium for retaining electrostatic latent images thereon;

means for disposing said photoconductive medium having the electrostatic latent images thereon in an opposing relationship to said second surface of said transfer means;

means for applying a voltage between said transfer means and said photoconductive medium;

said liquid repellent layer being a material having a property of forming a surface tension contact angle in said pores therein and on said first surface greater than 90° with said liquid developer in the absence of said voltage, applied between said transfer means and said photoconductive medium, and of forming a surface tension contact angle smaller than 90° with the liquid developer in the presence of said applied voltage and said disposed electrostatic images, whereby the supplied liquid developer in the absence of said applied voltage is prevented from entering into said pores, in said liquid repellent layer at said boundary formed between said conductive substrate and said liquid repellent layer of said transfer means, and said supplied liquid developer wets the inside surfaces of said pores in said liquid repellent layer and exudes through said pores onto said second surface of said transfer means when said transfer means is exposed to an electric field created by said disposed electrostatic latent images and said applied voltage for transfer onto said disposed photoconductive medium.

2. Apparatus as claimed in claim 1, wherein said disposing means moves said photoconductive member from a first position whereat an electrostatic latent image is formed thereon, to a second position disposed in an opposed relationship with said second surface of said transfer means.

3. Apparatus as claimed in claim 1, wherein there is further included means for exposing said photoconductive member with a light image corresponding to the original image, said exposing means disposed in an opposing relationship to said second surface of said developer supply means.

4. Apparatus as claimed in claim 1, wherein said openings have a dimension in the range of 10 – 100$\mu$, and are spaced from each other a distance in the range of 10 – 100$\mu$.

5. Apparatus as claimed in claim 4, wherein the dimension of said openings is preferably in the range of 10 – 50$\mu$.

6. Apparatus as claimed in claim 1, wherein said liquid repellent layer of said assembly comprises resin materials and has a thickness in the range of 3 – 400$\mu$.

7. Apparatus as claimed in claim 6, wherein the thickness of said liquid repellent layer is preferably in the range of 5 – 330$\mu$.

8. Apparatus as claimed in claim 1, wherein said photoconductive member comprises a first layer having a photoconductive property, and a second layer having the properties of low conductivity and transparency to a radiation image directed therethrough to expose said first photoconductive layer.

9. Apparatus as claimed in claim 1, wherein said transfer means comprises a cylindrical member including said substrate and said liquid repellent layer.

10. Apparatus as claimed in claim 1, wherein said transfer means comprises a continuous, flexible belt including said substrate and said liquid repellent layer.

11. Electrostatic printing apparatus for developing an electrostatic latent image, with a liquid developer containing a water soluble coloring material, comprising:

a developer supply unit composed of an electrically conductive substrate forming a back surface of said developer supply unit, and a liquid repellent layer disposed within a range of 3 to 400u thick over said conductive substrate, forming a front surface of said developer supply unit and defining a boundary between said conductive substrate and said liquid repellent layer, said developer supply unit having uniformly closely spaced 10 to 100u pores in said conductive substrate and liquid repellent layer extending from said front surface to said back surface;

means for supplying said liquid developer to said back surface of said developer supply unit;

a photoconductive means having a surface for retaining an electrostatic latent image thereon, means for contacting said surface of said photoconductive means having said electrostatic latent image thereon with said front surface of said developer supply unit in an opposing relation thereto; and means for applying an electrostatic voltage of about 30 to 2000V between said developer supply unit and said photoconductive means disposed in said opposing relation thereto;

said liquid repellent layer being a material having a property of forming in said pores therein and on said front surface thereof a surface tension contact angle more than 90° with said liquid developer in the absence of said applied electrostatic voltage thereby preventing said liquid developer from flowing into said pores therein, and of forming a surface tension contact angle smaller than 90° in the presence of both said electrostatic image and said applied electrostatic voltage, thereby allowing said liquid developer to flow into said pores therein and onto said front surface thereof from said boundary;

whereby said liquid developer in said pores of said developer supply unit exposed to said electrostatic field and said electrostatic latent image flows through said pores to exude onto said front surface of said developer supply unit and adhere to said surface of said photoconductive means, thereby developing the electrostatic latent image thereon.

12. The apparatus of claim 11, wherein said repellent layer is a material selected from the group comprising poly-4-fluoroethylene, poly-3-fluoroethylene chloride, silicone varnish and alkyd resin.

13. The apparatus of claim 11, wherein said developer supply unit comprises a cylindrical member including said conductive substrate and said repellent layer forming an outer surface of said cylindrical member.

14. The apparatus of claim 11, wherein said developer supply unit comprises a flexible endless belt substrate.

15. Electrostatic apparatus for developing an electrostatic latent image with a liquid developer composed of at least water and a water soluble coloring material, said apparatus comprises:

a developer supply unit comprising a composite assembly of an electrically conductive substrate and a liquid repellent layer disposed on the conductive substrate forming a surface of said developer supply unit, said composite assembly having a plurality of pores extending therethrough;

means for supplying the liquid developer to the conductive substrate of said developer supply unit;

a photoconductive member having a surface for retaining an electrostatic latent image thereon;

means for disposing said photoconductive member having an electrostatic latent image thereon, in an opposing relationship to the surface of said developer supply unit;

means for applying a voltage between said photoconductive member and said developer supply unit;

said liquid repellent layer of said developer supply unit having a property of forming a surface tension contact angle greater than 90° with the liquid developer in the absence of said voltage applied between said photoconductive member and said developer supply unit and forming a surface tension contact angle smaller than 90° in the presence of said applied voltage and said electrostatic latent image, whereby said liquid developer passes through the pores to exude onto said surface of said developer supply unit;

said means for disposing causing said photoconductive member to contact said surface to thereby develop said electrostatic latent image on said photoconductive member.

16. The apparatus of claim 15, wherein said repellent layer thickness in the range of 3–400u and the size of said pores is in the range of 10–100u.

17. An electrostatic apparatus for developing an electrostatic latent image on a photoconductive member as in claim 15, wherein said developer supply unit is cylindrical in shape.

18. An electrostatic appartus for developing electrostatic latent images on a photoconductive member as in claim 15, wherein said developer supply unit is in the form of a belt.

* * * * *

UNITED STATES PATENT AND TRADEMARK OFFICE

CERTIFICATE OF CORRECTION

PATENT NO. : 4,023,898

DATED : May 17, 1977

INVENTOR(S) : Genji Ohno et al

It is certified that error appears in the above-identified patent and that said Letters Patent are hereby corrected as shown below:

Column 8, in the chart under Example 1, change "Bromphenal" to -- Bromophenal --; change "1.5 c" to -- 1.5cc --.
Column 14, line 15, change "appartus" to -- apparatus --.

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*